US005408220A

United States Patent [19]

Brown et al.

[11] Patent Number: 5,408,220

[45] Date of Patent: Apr. 18, 1995

[54] PURSES WITH BREAKAWAY SHOULDER STRAPS

[76] Inventors: Paul W. Brown; Betty L. Brown, both of 3533 Chalmers, Saginaw, Mich. 48601-7125

[21] Appl. No.: 162,221

[22] Filed: Dec. 6, 1993

[51] Int. Cl.[6] ..... G08B 13/02

[52] U.S. Cl. ..... 340/571; 24/588; 24/602; 24/698.1; 150/110; 340/568

[58] Field of Search ..... 150/107, 110, 108; 340/571, 568; 24/588, 602, 698.1

[56] References Cited

U.S. PATENT DOCUMENTS

| | | | |
|---|---|---|---|
| 3,408,703 | 11/1968 | Brandenburg | 150/107 |
| 3,564,672 | 2/1971 | McIntyre | 24/632 |
| 3,701,140 | 10/1972 | Dixon | 340/571 |
| 3,851,326 | 11/1974 | Costa | 340/571 |
| 3,855,669 | 12/1974 | Meyer | 24/16 PB |
| 4,140,164 | 2/1979 | Staup | 150/110 |
| 4,383,350 | 5/1983 | Coty | 24/602 |
| 4,777,703 | 10/1988 | Knox | 24/170 |
| 4,881,672 | 11/1989 | Gustafson | 340/571 |
| 5,027,477 | 7/1991 | Seron | 24/602 |
| 5,119,910 | 6/1992 | Heggeland | 150/110 |
| 5,148,582 | 9/1992 | Dennis, Jr. | 24/615 |

*Primary Examiner*—Glen Swann

[57] ABSTRACT

A new and improved purse with a breakaway shoulder strap has a container for receiving and holding miscellaneous contents of a user, the container having opposed upper side edges. An elongated strap has a first segment and a second segment, each segment having an exterior secured end attached to an associated upper side edge of the container. Each segment has an intermediate free end. An attachment means releaseably couples the adjacent intermediate free ends of the segments. Breaking the coupling may be used to activate an alarm.

5 Claims, 3 Drawing Sheets

PURSES WITH BREAKAWAY SHOULDER STRAPS

BACKGROUND OF THE INVENTION

1. Field of the Invention

The present invention relates to purses with breakaway shoulder straps and more particularly pertains to purses with straps which break away from the user when excessive force is applied as during a mugging.

2. Description of the Prior Art

The use of purses and handbags is known in the prior art. More specifically, purses and handbags heretofore devised and utilized for the purpose of carrying objects of a user are known to consist basically of familiar, expected, and obvious structural configurations, notwithstanding the myriad of designs encompassed by the crowded prior art which had been developed for the fulfillment of countless objectives and requirements.

By way of example, the prior art discloses breakaway straps for various purposes including purses in U.S. Pat. Nos. 3,855,669 to Meyer and No. 5,119,910 to Heggeland. In addition, quick release buckles are disclosed in U.S. Pat. Nos. 3,564,672 to Mcintyre; No. 4,777,703 to Knox and No. 5,148,582 to Dennis.

In this respect, the purses with breakaway shoulder straps according to the present invention substantially departs from the conventional concepts and designs of the prior art, and in doing so provides an apparatus primarily developed for the purpose of protecting users in the event of a mugging.

Therefore, it can be appreciated that there exists a continuing need for new and improved purses with breakaway shoulder straps which can be used to protect users in the event of a mugging. In this regard, the present invention substantially fulfills this need.

SUMMARY OF THE INVENTION

In view of the foregoing disadvantages inherent in the known types of purses and handbags now present in the prior art, the present invention provides an improved purses with breakaway shoulder straps. As such, the general purpose of the present invention, which will be described subsequently in greater detail, is to provide a new and improved purse with breakaway shoulder straps and method which has all the advantages of the prior art and none of the disadvantages.

To attain this, the present invention essentially comprises a new and improved purse with a breakaway shoulder strap comprising, in combination, a container for receiving and holding miscellaneous contents of a user, the container having opposed upper side edges an elongated strap having a first segment and a second segment, each segment having an exterior secured end attached to an associated upper side edge of the container, each segment having an intermediate free end releasably coupleable to each other; attachment means releaseably coupling the adjacent intermediate free ends of the segments, the attachment means including a rigid tab coupled with respect to the free end of the first segment with an enlargement at its exterior end extending beyond the first segment and a resilient recess at the free end of the second segment with an enlargement at its interior end whereby the tab and its enlargement may be inserted into the recess and its enlargement for coupling the segments until an excessive force is applied to the segments to effect the separation of the tab and its enlargement from the recess and its enlargement and the separation of the two segments from each other, the first segment including adjacent to its exterior end a buckle with a crossbar with the crossbar forming the interior end of the tab; and a supplemental short strap overlying the second segment adjacent to its exterior end with the exterior end of the short strap in abuttment with the adjacent edge of the buckle when the segments are coupled.

There has thus been outlined, rather broadly, the more important features of the invention in order that the detailed description thereof that follows may be better understand, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying our the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved purses with breakaway shoulder straps which has all the advantages of the prior art purses and handbags and none of the disadvantages.

It is another object of the present invention to provide a new and improved purses with breakaway shoulder straps which may be easily and efficiently manufactured and marketed.

It is a further object of the present invention to provide a new and improved purses with breakaway shoulder straps which is of a durable and reliable construction.

An even further object of the present invention is to provide anew and improved purses with breakaway shoulder straps which is susceptible of a low cost of manufacture with regard to both materials and labor, and which accordingly is then susceptible of low prices of sale to the consuming public, thereby making such purses with breakaway shoulder straps economically available to the buying public.

Still yet another object of the present invention is to provide a new and improved purses with breakaway shoulder straps which provides in the apparatuses and methods of the prior art some of the advantages thereof, while simultaneously overcoming some of the disadvantages normally associated therewith.

Yet another object of the present invention is to protect users of purses with shoulder straps in the event of a mugging.

Even still another object of the present invention is to allow the breaking away of a purse at the shoulder strap when excess force is applied.

Lastly, it is an object of the present invention to provide a new and improved purse with a breakaway shoulder strap comprising a container for receiving and holding miscellaneous contents of a user, the container having opposed upper side edges; an elongated strap having a first segment and a second segment, each segments each having an exterior secured end attached to an associated upper side edge of the container, each segment having an intermediate free end releasably coupleable to each other; and attachment means releaseably coupling the adjacent intermediate free ends of the segments.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference numerals refer to similar parts throughout the various Figures.

DESCRIPTION OF THE PREFERRED EMBODIMENT

Figure 1:
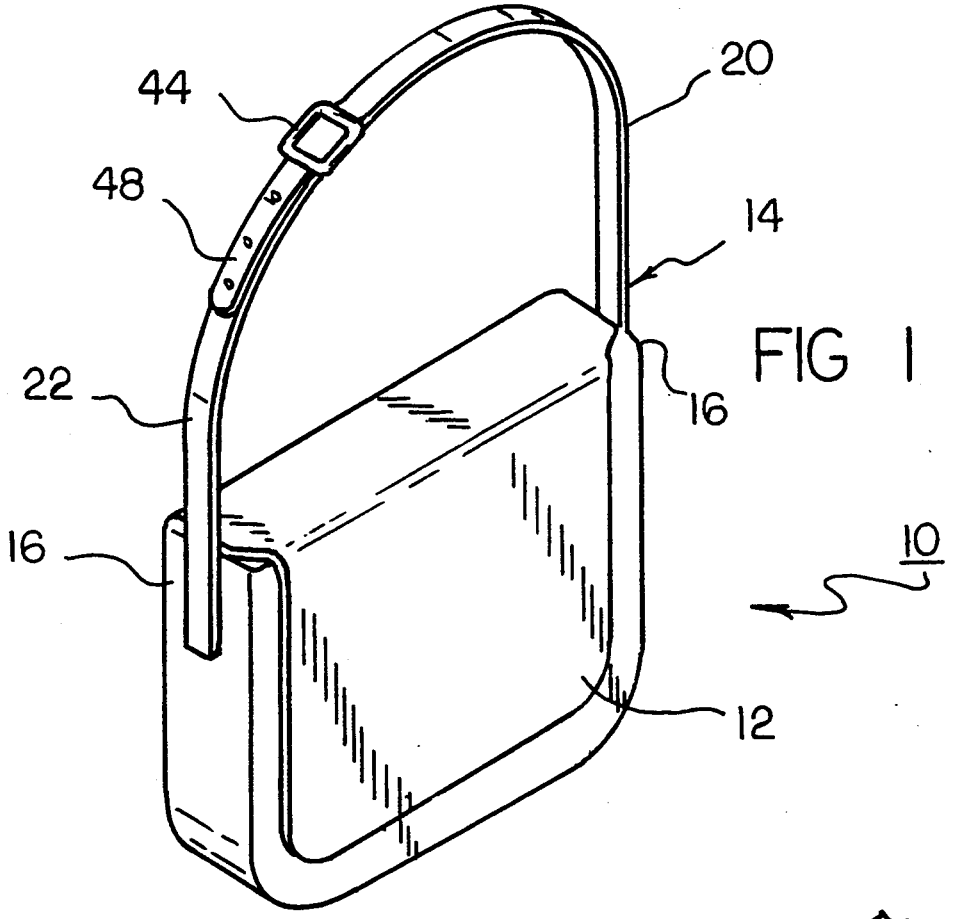
FIG. 1 is a perspective view of a purse with a breakaway shoulder strap constructed in accordance with the principles of the present invention.
Figure 2:
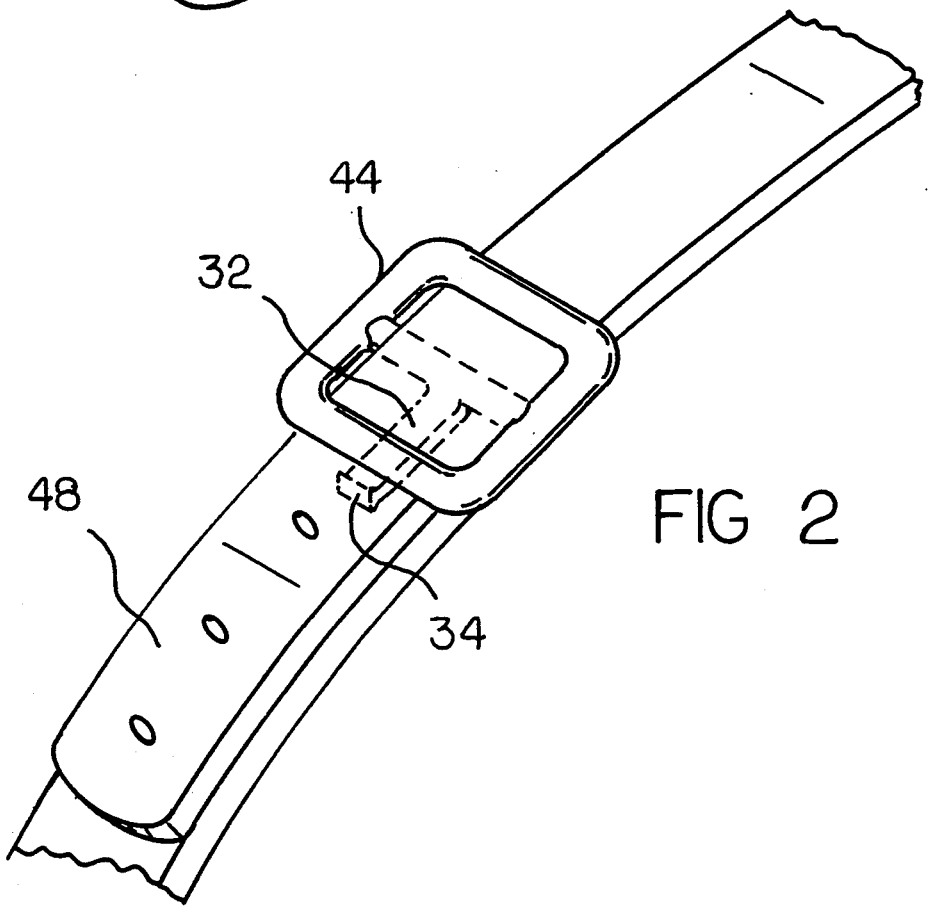
FIG. 2 is an enlarged perspective view of the breakaway section of the strap shown in FIG. 1
Figure 3:
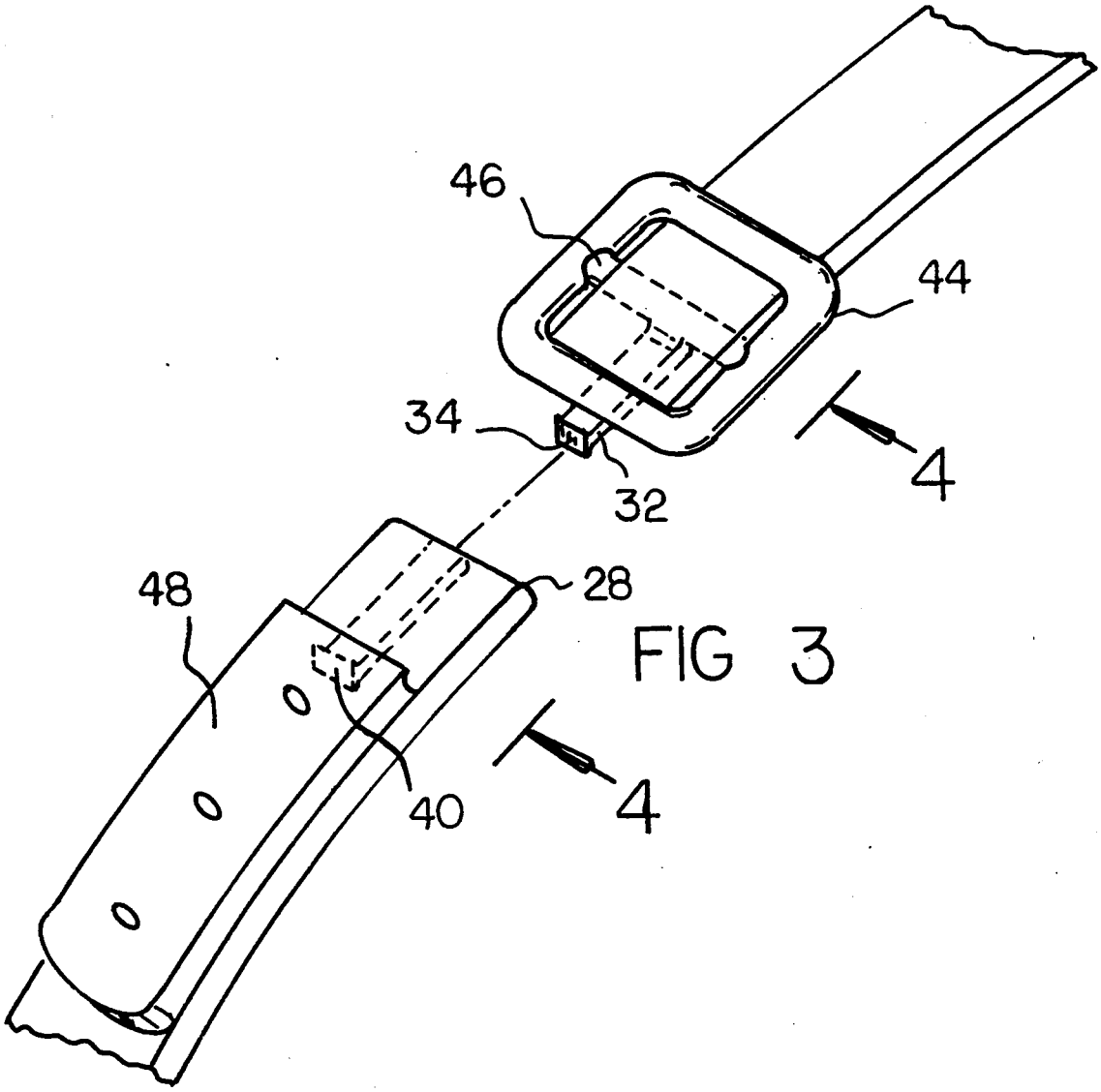
FIG. 3 is a perspective view similar to that in FIG. 2 but showing the straps separated.
Figure 4:
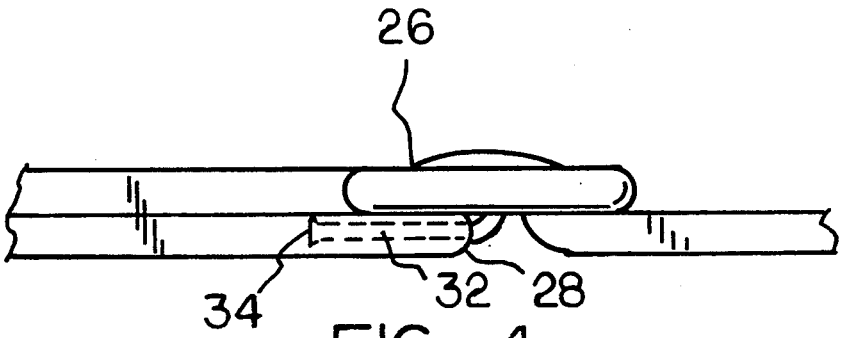
FIG. 4 is a side elevational view of the strap taken along line 4—4 of FIG. 3.

With reference now to the drawings, and in particular to FIG. 1 thereof, a new and improved purse with breakaway shoulder straps embodying the principles and concepts of the present invention and generally designated by the reference numeral 10 will be described.

More specifically, it will be noted in the various Figures that the invention is a purse 10 having a container 12 and strap 14.

The container 12 is generally conventional in configuration and has a main body portion which is for receiving and holding miscellaneous contents of a user. The container 12 also has opposed upper side edges 16. The strap 14 is elongated in shape and is fabricated of an essentially inextensible but resilient material, preferably plastic. The strap 14 includes a first segment 20 and a second segment 22. Each segment has an exterior secured end attached to an associated upper side edge 16 of the container. Each segment also has an intermediate free end 26 and 28 releasably coupleable to each other.

Coupling the segments 20 and 22 are attachment means for releaseably coupling the adjacent intermediate free ends of the segments. The attachment means include a rigid tab 32 coupled with respect to the free end of the first segment. The tab 32 is fabricated of a rigir material, preferably metal. It has an enlargement 34 at its exterior end extending beyond the first segment.

Located on the second segment 22 is a resilient recess at the free end of the second segment. It has an enlargement 40 at its interior end whereby the tab 32 and its enlargement 34 may be inserted into the recess and its enlargement 40. This action couples the segments until an excessive force is applied to the segments. An excessive force acts to effect the separation of the tab and its enlargement from the recess and its enlargement. The effects the separation of the two segments 20 and 22 from each other.

The first segment 20 includes, adjacent to its exterior end, a buckle 44. This buckle has a crossbar 46 forming the interior end of the tab 32. Further included is a supplemental short strap 48. The short strap overlies the second segment 22 adjacent to its exterior end. The exterior end of the short strap is thus in abuttment with the adjacent edge of the buckle when the segments are interconnected. An appearance of a conventional functioning buckle and purse strap is thus created, particularly when the short strap is formed with buckling holes as shown.

Figure 5:
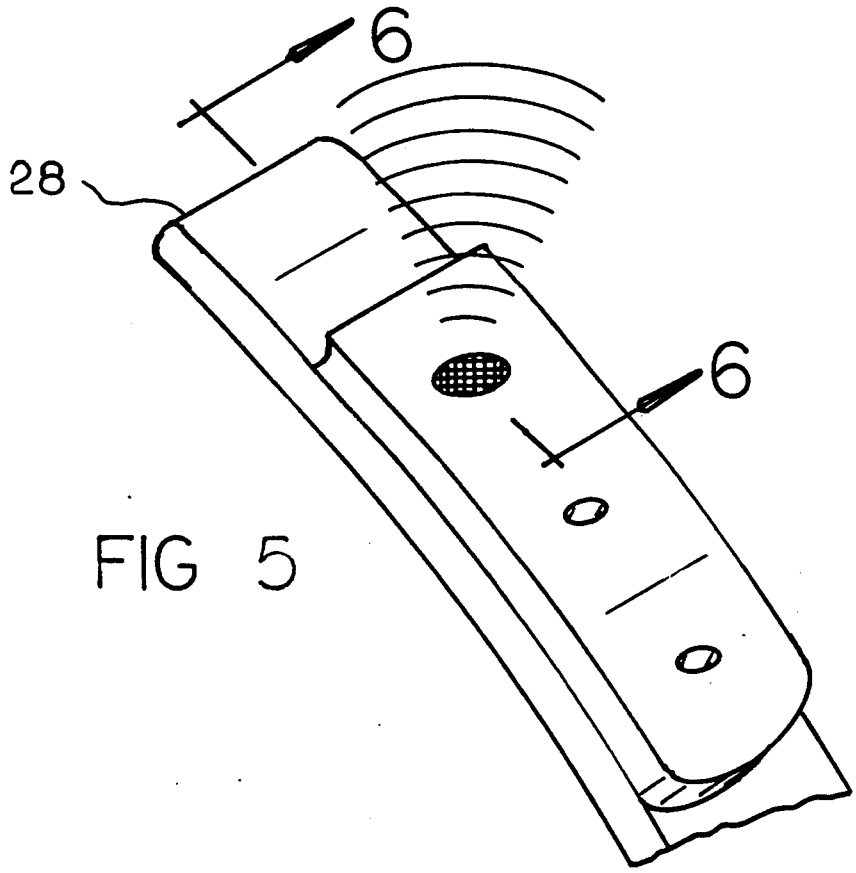
FIG. 5 is a perspective view of the second strap segment but constructed in accordance with an alternate embodiment of the invention.
Figure 6:
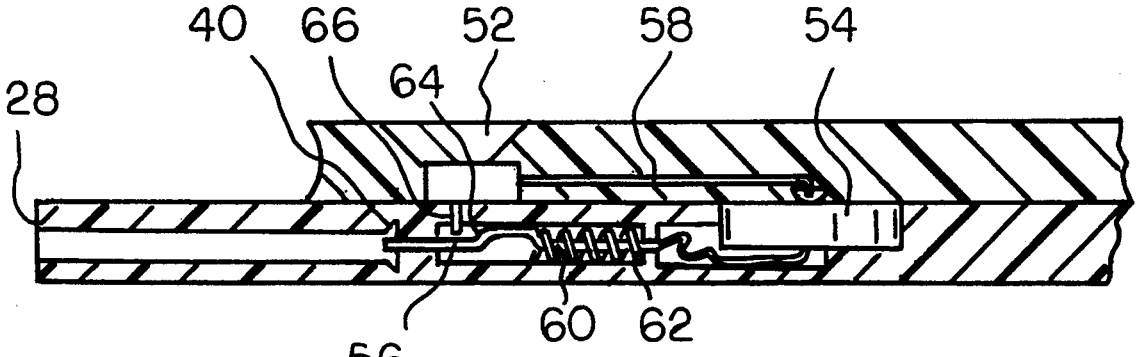
FIG. 6 is a sectional view of the strap taken along line 6—6 of FIG. 5.

In an alternate embodiment of the invention, as seen in FIGS. 5 and 6, a speaker 52 is provided in one of the components. The speaker functions to emit an audible sound or noise when the segments are separated. A battery 54 powers the speaker and a switch 56 couples the speaker and battery. The switch 56 is movable between an open orientation when the segments are coupled to preclude powering the speaker. The switch is also shiftable to a closed orientation to power the speaker and effect the noise. Permanent coupling is through a wire 58 between the battery and speaker. Releasable coupling is through a rigid shaped wire 60 urged by a spring 62 to the open position. Upon separation of the segments, a cam 64 on the rigid wire 60 contacts a follower 66 on the speaker 52 to emit an audible sound. The tab with its enlargement located within the recess and its enlargement acts to hold the stiff wire against the urging of the spring and the circuit open. In this manner no noise is emitted. Removal of the tab as caused by the tab with its enlargement being removed from within the recess and its enlargement acts to allow the stiff wire ti respond to the urging of the spring and the circuit thereby closes to allow the spring to expand, the cam to contact the follower of the speaker and a noise to be emitted.

The emitting of a noise from a purse which has had its strap separated as by a mugger will allow such mugger and pirse to be more readily found. In the alternative, the noise itself may cause the mugger to become frightened and simply drop the purse.

The present invention incorporates a break-away coupling into the shoulder strap. When it separates, the strap is not damaged. By sliding one member of the coupling back into the other, the strap is fully restored and is undamaged by the experience. The coupling can by made of plastic or metal and designed so that it is inconspicuous. It may appear to be a buckle for adjusting the length of the strap.

This invention can be applied to all kinds of purses or handbags, used by males as well as females. The purses can be made of any materials, in limitless shapes and sizes. The break-away provision accomplishes the purpose of protecting the person rather than preventing the theft.

The shoulder strap of the purse with which it is used separates when it is given a firm tug and receives an excessive force. It is designed to protect the woman or man user from being pulled off of their feet when their purse is snatched. The strap is usually slung over a shoulder, so when the purse is pulled away by the purse snatcher, the victim user is spun around violently. Rather than incurring an injury from a fall to the ground, or worse, the thief is allowed to make off with the bag without harming the victim.

Any confrontation with any mugger desperate enough to steal a purse is best avoided if at all possible. The result of a struggle with an unpredictable attacker often results in a serious injury to the victim. If the person is elderly, such injuries could be disabling.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention ot the exact construction and operation shown and described, and accordingly, all suitable modifications and equivalents may be resorted to, falling within the scope of the invention.

As to the manner of usage and operation of the present invention, the same should be apparent from the above description. Accordingly, no further discussion relating to the manner of usage and operation will be provided.

What is claimed as being new and desired to be protected by Letters Patent of the United States is as follows:

1. A new and improved purse with a breakaway shoulder strap comprising, in combination:

a container for receiving and holding miscellaneous articles, the container having opposed upper side edges;

an elongated strap having a first segment and a second segment, each segment having an exterior secured end attached to an associated upper side edge of the container, each segment having an intermediate free end releasably coupleable to each other;

attachment means releaseably coupling the adjacent intermediate free ends of the segments, the attachment means including a rigid tab coupled to the free end of the first segment with an enlargement at its exterior end extending beyond the first segment and a resilient recess at the free end of the second segment with an enlargement at its interior end whereby the tab and its enlargement may be inserted into the recess and its enlargement for coupling the segments until an excessive force is applied to the segments to effect the separation of the tab and its enlargement from the recess and its enlargement and the separation of the two segments from each other, the first segment including adjacent to its exterior end a buckle with a crossbar with the crossbar forming the interior end of the tab; and a supplemental short strap overlying the second segment adjacent to its exterior end with the exterior end of the short strap in abuttment with the adjacent edge of the buckle when the segments are coupled.

2. A new and improved purse with a breakaway shoulder strap comprising:

a container for receiving and holding miscellaneous articles, the container having opposed upper side edges;

an elongated strap having a first segment and a second segment, each segment having an exterior secured end attached to an associated upper side edge of the container, each segment having an intermediate free end releasably coupleable to each other; and attachment means releasably coupling the adjacent intermediate free ends of the segment, the attachment means being configured to simulate a buckle.

3. The apparatus as set forth in claim 2 wherein the attachment means includes a rigid tab coupled to the free end of the first segment with an enlargement at its exterior end extending beyond the first segment and a flexible recess at the free end of the second segment with an enlargement at its interior end whereby the tab and its enlargement may be inserted into the recess and its enlargement for coupling the segments until an excessive force is applied to the segments to effect the separation of the tab and its enlargement from the recess and its enlargement and the separation of the two segments from each other.

4. The apparatus as set forth in claim 3 wherein the first segment includes adjacent to its exterior end a buckle with a crossbar with the crossbar forming the interior end of the tab.

5. The apparatus as set forth in claim 2 and further including a speaker attached to one of the segments to emit an audible sound when the segments are separated, a battery to power the speaker and actuator mechanisms coupling the speaker and battery movable between an open orientation when the segments are coupled to preclude powering the speaker and a closed orientation to power the speaker.

* * * * *